United States Patent [19]

Mauer

[11] Patent Number: 4,803,902

[45] Date of Patent: Feb. 14, 1989

[54] REENCODING OF LOCKS

[75] Inventor: Guenter Mauer, Heiligenhaus, Fed. Rep. of Germany

[73] Assignee: Mauer GmbH, Heiligenhaus, Fed. Rep. of Germany

[21] Appl. No.: 118,795

[22] Filed: Nov. 9, 1987

[30] Foreign Application Priority Data

Nov. 8, 1986 [DE] Fed. Rep. of Germany ..... 3638186

[51] Int. Cl.[4] ..... E05B 35/12

[52] U.S. Cl. ..... 70/339; 70/382

[58] Field of Search ..... 70/339, 337, 338, 340, 70/355, 383, 382, 384

[56] References Cited

U.S. PATENT DOCUMENTS

| | | | |
|---|---|---|---|
| 1,693,731 | 12/1928 | Sioberg | 70/383 |
| 3,772,904 | 11/1973 | Parrock | 70/339 |
| 3,983,728 | 10/1976 | Phillips | 70/339 |

*Primary Examiner*—Robert L. Wolfe

*Attorney, Agent, or Firm*—Ralf H. Siegemund

[57] ABSTRACT

An adjustable and encodible lock for room doors, safe deposit boxes or the like, under utilization of two separate lock structures includes two separate sets of tumblers possibly arranged vertically one above each other; a main slide coupled to an existing lock cylinder or to the common lock or latch or both, the main slide has two follower pins (13*b* and 13*c*); the upper tumbler system may be aligned with a cylinder axis of an existing lock; the lower tumbler system is then axially aligned with a latch handle and a lock disk for locking and unlocking the main slide; two control slides (21, 22) are respectively associated with the separate two lock and tumbler sets and are respectively provided with cutouts (21*c*, 22*c*) for engagements with the two follower pins; a first one of the tumbler set is provided for being operated by a customer key, the other one of the sets is provided for operation by a management key; each tumbler of the first set has funnel shaped control cutouts; and an intermediate slide is provided with a cam for engagement with the management key and has a control pin for operating and reorganizing the tumbler elements of the first tumbler set as a customer key for new adjustment is inserted in the engagement with the first tumbler set.

8 Claims, 2 Drawing Sheets

FIG. 4
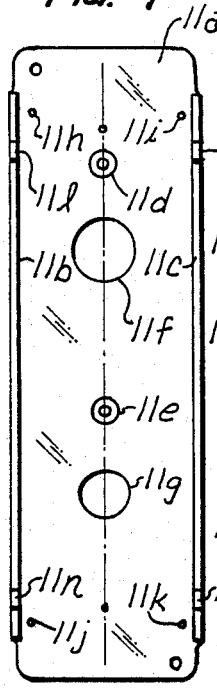
FIG. 5
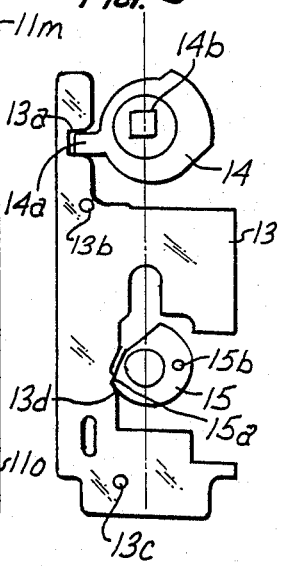
FIG. 6
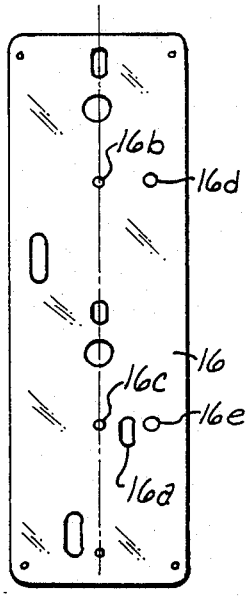
FIG. 7
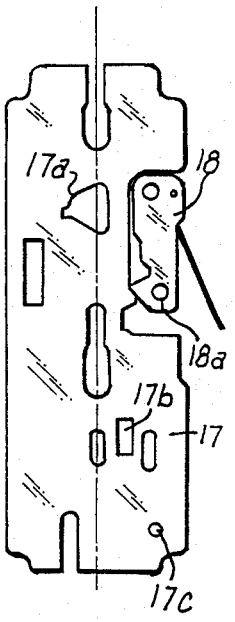
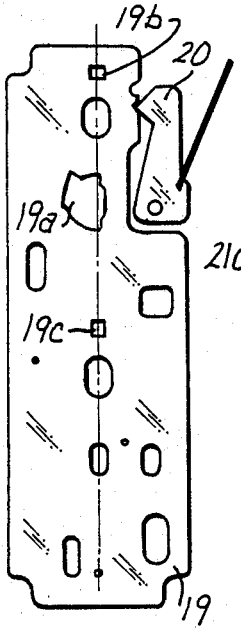
FIG. 8
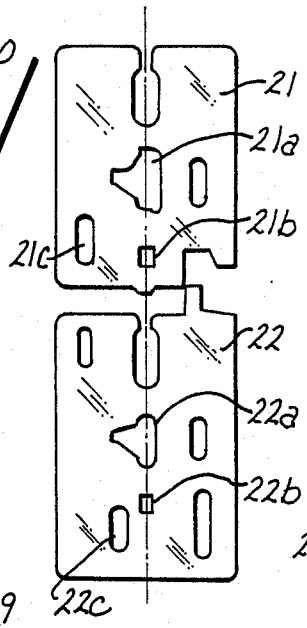
FIG. 9
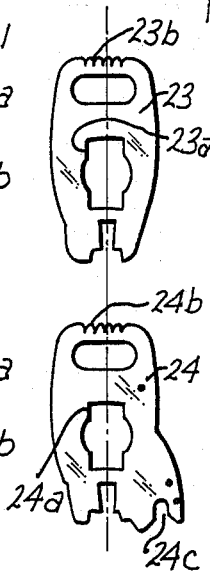
FIG. 10
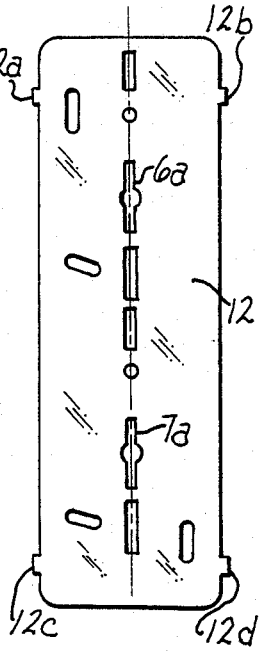
FIG. 11

REENCODING OF LOCKS

BACKGROUND OF THE INVENTION

The present inventio relates to an adjustable i.e. reencodible lock and key arrangement for doors, safe boxes or the like with two lock structures respectively associated with management and customer operation to operate independent from each other a common bolt.

In the case of rented safe deposit boxes it is customary to provide the door with two locks in order to make sure that two people are required for access to the box. This way an unauthorized use of one key or the other does not enable a particular person to gain access and e.g. burglarize the box. This then is a case of mutual dependency.

Furthermore it is customary in cases of safes or the like, particularly large bank vaults, walk-in safes to provide multiple locks for mutual monitoring and to prevent dishonest employees or bank robbers from gaining access to vaults, or to prevent hostage taking or the like. Multiple dependency for access requirements makes access more difficult. In all these instances multiple locks are to be operated requiring so to speak different independent sources before access is possible.

Aside from banks, other fields of use exist for safe deposit boxes, strong boxes or the like particularly in the private sphere such as hotels, offices or the like. In modern hotels the guest rooms and other rooms are individually accessible and through master keys; additional access is posible e.g. certain submaster keys gives access to all rooms in one floor. The general master key permits access to all rooms. Such a system is disadvantaged for the following reasons. If an individual key is lost the tumblers can be adjusted in a fairly simple fashion or exchanged. In the case of submaster keys or general master keys being lost or stolen, the situation is of course very different.

The new electronic locks no longer provide for access through a regular key but through encoded key cards. The encoding may be electrical or magnetical. These electronic keys can simply be reprogrammed or reencoded whenever there is a guest change. Such a key and lock combination requires electric current supply and other signal lines to run to the door which or course requires extensive stringing of cables and wires. The signal lines to be included should also provide for an indication as to the state of opening and closing of any and all doors. It is quite apparent that a hotel that is newly constructed may have cables installed in a comparatively simple fashion. The situation is quite different for refurbishing existing hotels. This is particularly so if under surface installation requires chiseling to open up the walls. Another disadvantage of course is the fact that electric or electronic lock and key arrangement of the type thus mentioned are more likely to be subject to interference as compared with purely mechanical locks. The maintenance problem is also increased.

DESCRIPTION OF THE INVENTION

It is an object of the present invention to provide a new and improved lock and key system which permits reprogramming and readjusting while being safe as far as unauthorized copying is concerned. It is another object of the present invention to provide a new add-on lock which is particularly suitable for installation in already existing hotels.

In accordance with the preferred embodiment of the present invention, it is suggested to provide each lock independent from the respective other one to operate a common bolt, latch or the like; a main slide has two follower pins which engage an upper management controlled control slide and a lower customer controlled slide (or vice versa). These control slides are respectively associated with an upper set and a lower set of tumblers which in turn are operated by a management key and a customer key. The main slide is either coupled to an existing lock (bolt, latch etc.) through a cylinder arrangement and keying to the existing cylinder or the main slide carries or operates its ownlock, bolt etc. The connections as far as the customer tumbler set is concerned, is provided with additional funnel shaped control openings in the tumbler elements and an intermediate slide with contoured cam is provided for operation by the management key while having a control pinfor reorganizing the customer lock and tumblers particularly during change-over to another customer key. The basic concept underlying the invention is that on change of a guest or even in case of a loss of the guest or customer key the manager can change the customer lock to a key of different encoding so that misuse is almost completely excluded.

In the preferred form of practicing the invention the lock is a box king of lock which can simply be added on or superimposed on any existing door lock with very little structural changes. It is only required to remove the handle, the shield and the tumbler cylinder; fastening then is carried out by means of screws which are inserted from the inside. In case of a lock with 7-fold tumbler locking possibilities there are 78125 combinations possible. Theoretically it is possible to change the lock every day to a different one of altogether 78000 keys. Of course the same system can be installed with ease in new hotel or office constructions while the invention is envisioned primarily for room locks it can be used analogously for containers e.g. strong boxes, safes or the like.

DESCRIPTION OF THE DRAWINGS

While the specification concludes with claims particularly pointing out and distinctly claiming the subject matter which is regarded as the invention, it is believed that the invention, the objects and features of the invention and further objects, features and advantages thereof will be better understood from the following description taken in connection with the accompanying drawings in which:

FIG. 4–FIG. 11 illustrate the various parts of the lock in individual top elevation wherein FIG. 4 illustrates the housing and FIG. 11 illustrates a cover; the components shown in FIGS. 5–10 are positioned in between.

Proceeding now to the detailed description of the drawings, FIG. 1 illustrates a door 1 which has the usual customary lock 2. The latch carries the number 3 also shown in the bolt and which, however, is no longer needed or used. FIG. 1 illustrates particularly the lock as an added-on feature. The lock is included in a cover or casing 5 which is suitably connected to the door. The key holes 6 and 7 have typical configurations for receiving a double bit key. The housing 5 is actually fastened to the door 1 from the inside of the room through screws which are not seen in FIG. 1 but can be seen in FIG. 2.

FIG. 2 shows the door portion from the inside of the room and here a screwed on lock shield 8 is provided which pertains to the new construction. This particular shield carries a first door knob handle 9 which, through the usual cylinder and actuator element actuates the latch 3. Another handle 10 serves for blocking any latch movement. This way one can prevent from the inside that anybody e.g. room service can open the door from the outside when the guest does not want to be distrubed. The arrow 10*a* on the handle indicates whether or not the lock is in the blocked position.

The detailed view of FIG. 3 the lock shows a U-shaped housing 11 with a flat cover 12 being provided with a plurality of aligned oblong slots. They include the two key holes 6*a* and 7*a*. Screws 25 and 26 are used to fasten the particular casing 11 to the door. FIG. 4 shows in particular details of the U-shaped lock case 11. It may be made of flanged or chamfered sheet metal or made through die casting. It includes a bottom plate 11*a* with elongatedside walls 11*b* and 11*c* facing each other. The plate 11*a* has an axis of symmetry on which are mounted two guide pins 11*d* and 11*e* each having a threaded bore.

Figure 1:
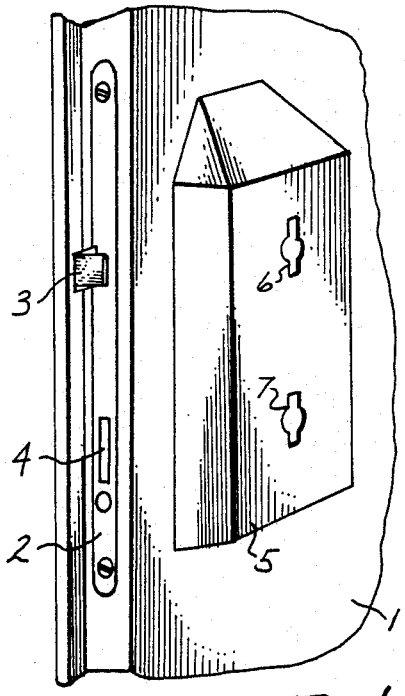
FIG. 1 is a perspective view of a room door with added on lock in accordance with the preferred embodiment of the present invention for practicing the best mode thereof.

Bottom plate 11a includes a larger annular opening 11*f* for supporting the key cylinder shown in FIG. 5 in greater detail. A small opening 11*g* is provided to receive a locking disk also shown in greater detail in FIG. 5. Four threaded bores 11*h–k* are provided to fasten an intermediate cover or partition 16 as shown in FIG. 6. Cutouts 11*l–*11*o* are provided in pairs in the side walls 11*b* and 11*c* for guiding and holding and defining the position of the cover 12 or lid shown in FIG. 11.

FIG. 5 shows the main slide or bolt 13 being in cross section reduced particularly in the area of the cylinder 14. A cutout 13*a* reaches around the nose 14*a* of the cylinder element 14 being moreover provided with a squareshaped keying hole 14*b*. As the slide or bolt 13 is shifted up, the key cylinder 14 is rotated in clockwise direction. The cylinder element 4 is connected through a square shaped key (not shown) with the cylinder of the existing lock 2 (not shown) so that the movement of the main bolt 13 of his add-on lock results in a retraction of the latch 3 of that lock 2.

The lock disk 15 assumes a position such that its corner point 15*a* blocks the slide 13 by engagement with a locking nose indent 13*d*. Upon turning disk 15 to the left by about 30 degrees the blocking is removed. A guide pin 15*b* slides in a slot 16*a* of the partition and intermediate cover 16 such that the turning range of the blocking disk 15 is limited. Slide 13 carries two follower pins 13*b* and 13*c* which engage the slides 21 and 22 shown in FIG. 9. The intermediate cover and partition 16 shown in FIG. 6 include in addition to the various perforations two pins 16*b* and 16*c*. Another pin 16d serves as pivot, mounting or bearing pin for a control lever 18 shown in FIG. 7. Pin 16*e* traverses intermediate slide 17 and engages the changeover or repositioning slide 19 (FIG. 8) and one of the slides, 22, shown in FIG. 9.

FIG. 7 shows the intermediate slide 17 with control cam 17*a* being provided for engagement with the master key. The intermediate slide 17 being further provided with a control cam and cam surface 17*a* for engagement with the master key (and no other). Of particular importance is another cutout 17*b* which upon adjusting the slide carries along the pin 15*b* and releases the main slide 13. In emergency cases then the manager can open the door even if the door is locked from the inside. Pin 17*c* is provided on slide 17 having significance to be explained more fully below.

The intermediate slide 17 moreover cooperates with and actuates the control lever 18 whose pivot is established by pin 16*d* on 16. Lever 18 has a control pin 18a which blocks the lower slide (22) shown in FIG. 9 whenever the management key is turned by about 180 degrees. FIG. 8 shows the repositioning slide 19 with a cam 19*a* for engagement with the master key. Also shown are the changeover or repositioning control pins 19*b* and 19*c*. The two slide positions refer respectively to holding the tumbler or bolt keeper and release thereof for exchange or repositioning. These positions are both locked by means of a latch lever 20.

FIG. 9 shows the control pin slide 21 for the management lock portion and being arranged above the control pin slide 22 of the customer portion. Cutouts 21*c* and 22*c* respectively couple the slides 21 and 22 to the main slide 13 to independently operate the latter as the common element. Respectively corresponding cams 21*a* and 22*a* cooperate with control pins 21*b*, 22*b* on slides 21 and 22 respectively. FIG. 10 shows the devices 23 and 24 abuting the slides 21 and 22 respectively. Slots 23*a* and 24*a* respectively in tumblers 23, 24 reach around pins or posts 11*d* and 11*g* that extend from housing 11 as shown in detail in FIG. 4. The gears 23*b* and 24*b* are held by this pin 19*b* and 19*c* following new encoding and repositioning. The tumblers 24 have a particularly simple configuration. In the lower right they show a widening with an insertion funnel 24*c*.

Whenever the master key is turned slide 17 (FIG. 7) is moved up and the pin 17*c* reorients the tumbler devices 24 in an uniform manner and corresponding to the new customer key that has been inserted in 7*a–*22*a*. Thus, when the lock is changed to accommodate a new customer key it is no longer required that the previous key that a prior guest or customer had used up to this point be used i.e. inserted and operated. All parts of the locks are held together by the cover or lid 12 being bolted to the post 11*d* and 11*e*. The projections 12*a–*12*d* moreover positioning and indexing on the casing 11.

Figure 2:
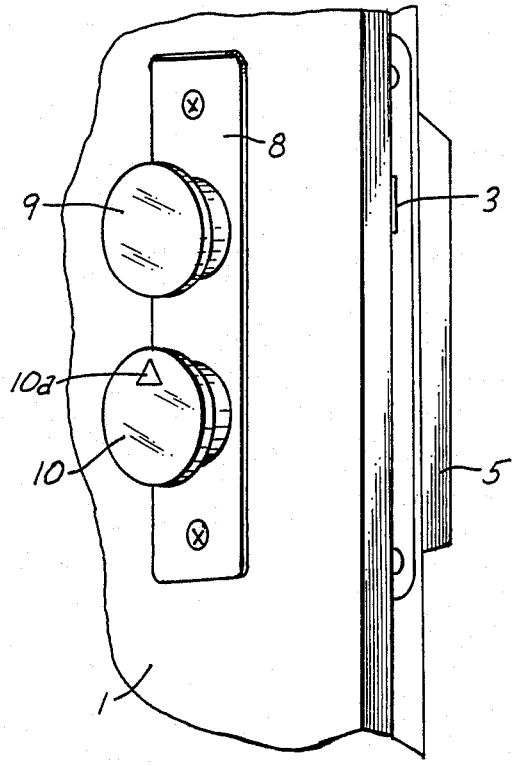
FIG. 2 shows the same lock but now from the inside of a room.
Figure 3:
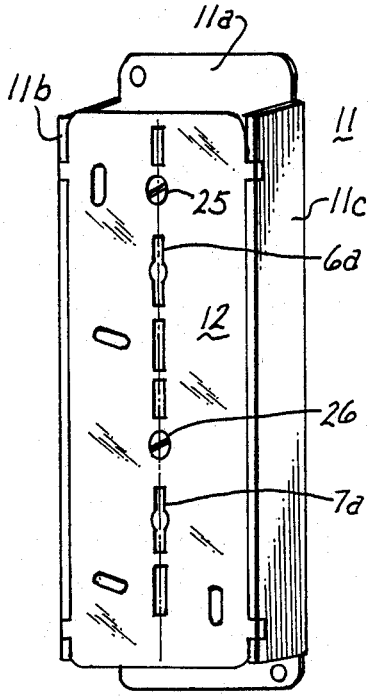
FIG. 3 shows the lock proper used in FIG. 1 and FIG. 2 in a perspective view.

As far as the relation to the existing lock structure (Figs. 1,2) is concerned, one can see that the two tumbler sets 23,24 are respectively aligned with the cylinder axis of the existing lock and with the lower key hole thereof whereby the lock axis is coaxial with the handle 10 while the former is coaxial with handle 9.

The new lock is operated and used as follows. The guest or customer places his or her key into the lower key hole (7*a*) and turns to shift the slide 13 so that the 13*a*/14*a* interaction causes cylinder 14 to rotate and the latch 3 is released and the door is released then he turns the key back and pulls it out. For opening from the inside one simply uses the upper handle 9 which turns directly cylinder 14 to operate latch 3.

Asuming that the room is vacatd and it is prepared for a new guest who will receive a (randomly selected) new key. This key is now used by the manager to adjust the lock to match that particular key. For this the master key is inserted into the appropriate lock and turned by 180 degrees in order to move the repositioning control slide 19. The slide 19 has normally a position in which the tumblers 24 are held in a particular position, on shifting slide 19 by management key operation the tumblers 24 are released. Also, the intermediate slide is shifted so that the control pin 18a may lock the lower slide 22. In addition, shifting of slide 17 through pin 17*c* reorganizes the tumblers 24 (17*c* is inserted in funnels 24*c*) in matching relation to the new customer key that has been inserted (7, 7*a*) and turned by 90 degrees. The management key is now turned back and retracted and all tumbler locking devices of the customer lock are now matched to the newly assigned key.

One can see that a significant advantage of the inventive system entails that one no longer needs the previously matching and fitting key in order to accommodate new encoding. This is a facilitation in terms of organization and beneficial if for example the previously fitting key is lost, has been stolen or has been accidentally (or intentionally) taken along by the guest. It is important that in fact whenever an emergency arises, the key holder can in fact have his "keying power" revoked. This may be advisable in case there is (or is suspected) some misuse or the like.

Changing the keys and locks for a general change occupancy can be carried out from floor to floor, one simply changes one door after another—just switches randomly the keys and locks around since the assignment between newly adjusted lock and key to the respective room numbers can be carried out on the spot; the whole procedure is fairly simple.

The particular lock and key as described was particularly described as equipment for refurnishing existing hotels. It is easily suited for that purpose since as stated merely door handles, key covers and tumbler cylinders have to be removed but the entire standardized lock does not have to be removed. One simply drills two or four fastening bores and inserts the lock with the square shaped key and bolts it down to the inside key shield. Following that the handles are affixed. Since the cover and the new key shield are larger usually than the old ones one does not even have to repaint the door around the key area.

On refurbishing, as described, the locks in hotels the longitudinal axis of each lock housing is oriented in vertical direction. In case of newly manufactured doors one could instead install it with a horizontal orientation of the mainaxis and to insert the equipment directly under this orientation assuming a minimum thickness of the doors of 50 mm. The lock proper is about 30 mm thick for seven closing tumblers. In this case main slide 13 is extended either by a bolt or by means of a latch arranged on the slide. In other words one does not need the cylinder 14 or one does not need a connect structure to an existing cylinder, bolt,latch etc. Rather, the slide can be additionally provided with means for locking a latching. This may be a cylinder such as 14 which then is equipped with a latch or a deadbolt. Alternatively, and this is particularly the case if one turns the entire arrangement by 90 degrees, the slide 13 is furnished with a bolt or a latch.

In the case of a horizontal arrangement of the main axis and supplemental latch elements the box lock can be provided on the rear side of a safe deposit box or the like, particularly a room safe. Preferably one uses one and the same key for the room and the safe. This has the advantage for the guest to need only onekey and he will not confuse two basically similarly constructed keys. For safety reasons the room safe may require a different special master key as far as management operation is concerned. This way it is impossible for cleaning and other service personnel to gain access to the room safe. In order that the guest accidentally pushes his key into the management keyhole 6, 6a the pin 16b may have a larger diameter than the pin 16. This way it is impossible to mix the two keys up. The same is true and can be observed for the key bores. For avoiding mix-up one could also cover normally the key hole 6 with a little flap or the like.

The invention is not limited to the embodiments described above but all changes and modifications thereof, not constituting departures from the spirit and scope of the invention, are intended to be included.

I claim:

1. Adjustable and encodible lock for room doors, safe deposit boxes or the like, under utilization of two separate lock structures comprising in combination;

two separate sets of tumblers;

a main slide coupled to an existing lock cylinder or to the common lock or latch or both, said main slide having two follower pins (13*b* and 13*c*);

first and second control slides (21, 22) respectively associated with the separate two lock and tumbler sets and respectively provided with cutouts (21*c*, 22*c*) for engagements with said two follower pins;

a first one of the tumbler set being provided for being operated by a customer key, the other one of the sets provided for operation by a management key;

each tumbler of the first tumbler sets having funnel shaped control cutouts; and an intermediate slide with a cam for engagement with the management key and having a control pin for operating and reorganizing the tumbler elements of the first tumbler set as a customer key for new adjustment is inserted in for engagement with the first tumbler set.

2. Lock in accordance with claim 1 wherein said main slide has a locking nose cooperating with a blocking disk being operated from the inside through a handle.

3. Lock for attachment to an existing lock and having the features as set forth in claim 1, further including:

the two tumbler systems being vertically arranged one above each other;

the upper tumbler system being provided for alignment with a cylinder axis of an existing lock;

the lower tumbler system being axially aligned with a latch handle and a lock disk for locking and unlocking the main slide.

4. Lock as in claim 1, a management pin having a different diameter as a customer pin on an intermediate cover and position (FIG. 6).

5. Lock as in claim 1, said main slide being connected, through a cylinder, to a latch of an existing door.

6. Lock as in claim 5, there being an additional handle for connection to said cylinder.

7. Lock as in claim 1, there being an externally adjustable and operable blocking means for preventing the main slide from shifting.

8. Lock as in claim 7, including means for overriding the blocking means in cooperation with the actuator of the other tumbler set.

* * * * *